United States Patent [19]

Kouyama et al.

[11] Patent Number: 4,816,335

[45] Date of Patent: Mar. 28, 1989

[54] HIGH-QUALITY POLYARYLENE-THIOETHER FIBERS AND METHOD FOR PRODUCTION THEREOF

[75] Inventors: Toshitaka Kouyama; Harunobu Egawa; Yo Iizuka; Zenya Shiiki, all of Fukushima, Japan

[73] Assignee: Kureha Kagaku Kogyo Kabushiki Kaisha, Tokyo, Japan

[21] Appl. No.: 842,842

[22] Filed: Mar. 24, 1986

[30] Foreign Application Priority Data

Mar. 22, 1985 [JP] Japan ..... 60-58069

[51] Int. Cl.[4] ..... D02G 3/00

[52] U.S. Cl. ..... 428/364; 528/373; 528/388; 264/210.8

[58] Field of Search ..... 428/364; 528/374, 373, 528/388; 264/210.8

[56] References Cited

U.S. PATENT DOCUMENTS

| | | | |
|---|---|---|---|
| 3,895,091 | 7/1975 | Short et al. | 528/388 |
| 3,898,204 | 8/1975 | Short et al. | 528/388 |
| 3,912,695 | 10/1975 | Short et al. | 528/388 |
| 4,098,776 | 7/1978 | Tieszen et al. | 528/373 |
| 4,115,562 | 9/1978 | Gragson et al. | 528/373 |

FOREIGN PATENT DOCUMENTS

| | | | |
|---|---|---|---|
| 0125600 | 11/1984 | European Pat. Off. | 528/388 |
| 0166368 | 1/1986 | European Pat. Off. | 528/388 |
| 0171021 | 2/1986 | European Pat. Off. | 528/388 |
| 3318401 | 11/1984 | Fed. Rep. of Germany | 528/388 |
| 59-49232 | of 0000 | Japan | 528/388 |
| 56-62121 | 5/1981 | Japan | 528/373 |
| 2019770 | 11/1979 | United Kingdom | 528/373 |

*Primary Examiner*—Lorraine T. Kendell

*Attorney, Agent, or Firm*—Wenderoth, Lind & Ponack

[57] ABSTRACT

High-quality polyarylene-thioether fibers are provided, which simultaneously satisfy the following conditions:

(a) the polyarylene-thioether is a linear polyarylene-thioether having a melt viscosity of 5,300 to 20,000 poise (at 310° C. and a shear velocity of 200 second$^{-1}$);

(b) the fiber diameter is in the range of 1 to 50 microns;

(c) the tensile strength is not less than 40 kg/sq.mm;

(d) the tensile modulus of elasticity is not less than 500 kg/sq.mm; and (e) the tensile strength at 200° C. is not less than 20 kg/sq.mm.

The fibers are produced by continuously melt-spinning a linear polyarylene-thioether polymer having a melt viscosity of 5,300 to 20,000 poise (at 310° C. and a shear velocity of 200 second$^{-1}$), continuously stretching the spun filament, and continuously heat-setting the stretched filament for 0.02 to 100 seconds at a temperature of not lower than the melting point of the polymer minus 100° C.

3 Claims, No Drawings

HIGH-QUALITY POLYARYLENE-THIOETHER FIBERS AND METHOD FOR PRODUCTION THEREOF

BACKGROUND OF THE INVENTION

1. Field of the Invention

This invention relates to polyarylene-thioether fibers having certain physical properties of exceptionally excellent (high) values (herein referred to as high-quality fibers) and a method for continuously producing these fibers. More particularly, it relates to high-quality fibers having properties which heretofore have not been mutually compatible and consisting essentially of a linear polyarylene-thioether having a melt viscosity of 5,300 to 20,000 poise (at 310° C. and a shear velocity of 200 second$^{-1}$) and relates well to a method for continuously producing these high-quality fibers without breaking and fluffing.

2. Prior Art

It has been expected that a polyarylene-thioether, and especially polyphenylene-thioether, can be processed into heat-resistant fibers having excellent properties, because they are highly crystalline thermoplastic polymers having thermal resistance. For example, methods for producing such fibers are disclosed in Japanese Patent Publication No. 30609/1977 and, Japanese Laid-open Patent Application Nos. 143518/1982 and 31112/1983.

These methods, however, use as starting materials a polymer having a relatively low melt viscosity, a non-linear polymer produced by high-temperature curing, or a non-linear polymer produced with a crosslinking agent in the course of polymerization. The unsatisfactory properties of fibers and the like observed in the case of a polymer having low melt viscosity may have been solved by the use of the latter non-linear polymer. Such nonlinear polymers, however, have poor spinnability and stretchability and suffer from breaking and fluffing in the course of continuous melt spinning and continuous stretching. Thus, it has been very difficult to industrially produce stretched filaments.

On the other hand, a linear polymer which is not crosslinked with the high-temperature crosslinking or crosslinking polymerization has lacked satisfactorily high melt viscosity. Such linear polymers have excellent spinnability and stretchability but have unsatisfactory fiber properties, have bad melt-breaking resistance, and suffer from melt breaking and fluffing in the course of continuous melt spinning and subsequent continuous heat setting. Thus, it has been also difficult to industrially produce stretched heat-set fibers and to obtain fibers having excellent mechanical properties and thermal resistance.

SUMMARY OF THE INVENTION

In order to solve the above mentioned problems, we have conducted intensive research and have found that stretched heat-set polyarylene-thioether fibers can be continuously produced by using as the starting material a non-crosslinked (i.e., linear structure) polyarylene-thioether having an especially high molecular weight (i.e., not less than 5,300 poise at 310° C. and a shear velocity of 200 second$^{-1}$ in terms of melt viscosity) and selecting suitable processing conditions.

Thus, the high-quality polyarylene-thioether fiber according to the present invention is characterized by simultaneously satisfying the following conditions:

(a) the polyarylene-thioether is a linear polyarylene-thioether having a melt viscosity of 5,300 to 20,000 poise (at 310° C. and a shear velocity of 200 second$^{-1}$;

(b) the fiber diameter is in the range of 1 to 50 microns;

(c) the tensile strength is not less than 40 kg/sq.mm;

(d) the tensile modulus of elasticity is not less than 500 kg/sq.mm.; and (e) the tensile strength at 200° C. is not less than 20 kg/sq.mm.

As the starting material for the polyarylene-thioether fibers obtained by the present invention, use is made of a linear polyarylene-thioether having a melt viscosity of 5,300 to 20,000 poise (at 310° C., and a shear velocity of 200 second$^{-1}$). These fibers have excellent mechanical properties such as tensile strength and tensile modulus of elasticity, which properties could not be obtained by using conventional polyarylene-thioether resins of a linear and low melt-viscosity polymer or a cure-crosslinked or polymerization-crosslinked polymer. Moreover, the present polyarylene-thioether has excellent thermal resistance (e.g., tensile strength at 200° C. of not less than 20 kg/sq.mm.), and also is not subject to fluffing and the like.

Use of the high-molecular linear polyarylene-thioether having a melt viscosity of 5,300 to 20,000 poise (at 310° C. and a shear velocity of 200 second$^{-1}$) has made it possible to continuously conduct melt-spinning, stretching and heat-setting steps and to industrially produce polyarylene-thioether fibers having the above mentioned excellent properties without fluffing and breakage. In contrast, conventional low-molecular or crosslinked polyarylene-thioether resins often cause fluffing and breaking. It has been difficult to conduct continuous spinning, stretching and heat-setting steps. Thus, the fibers having such excellent properties as produced according to the present invention could not be obtained because of insufficient stretching and heat with the conventional low-molecular polymer.

DETAILED DESCRIPTION OF THE INVENTION

Production of Fibers

Startinq Polymer

The polymer to be used in the present invention is a polyarylene-thioether. One of the important points is to select as the starting material a polymer having excellent spinnability, stretchability and melt-breaking resistance. Thus the polymer should be a linear type. That is, the polymer contains as the main component a repeating unit of —Ar—S—, wherein the —Ar— stands for an aromatic hydrocarbon group. Especially, a polymer having the repeating unit of

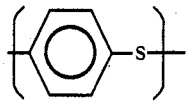

as the main component is highly preferred from the viewpoint of crystallizability, heat-resistant mechanical strength, chemical resistance, costs, etc. Of these polymers, a polymer containing in the polymeric chain 50 molar % or more of the repeating unit of

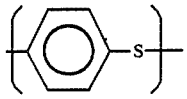

and 5 to 30 molar % of the repeating unit of

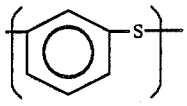

in a blockwise fashion is especially preferred because of its very excellent moldability in addition to the above mentioned characteristics.

The polyarylene-thioether to be used in the present invention is a linear polyarylene-thioether. The "linear polyarylene-thioether" herein means a polyarylene-thioether obtained by polymerization via dehalogenation/sulfiding of an alkali sulfide and a dihalo-substituted aromatic hydrocarbon substantially without using a crosslinking agent or a branching agent (e.g., a tri- or higher polyhalogen-substituted aromatic hydrocarbon) in the course of polymerization and also without substantially conducting crosslinking treatment after the polymerization (e.g., treatment of curing the polymer at a high temperature in the presence of oxygen to enhance its melt viscosity). Thus, the molecular structure of the resulting polymer is considered to be substantially linear.

In this connection, a polyarylene-thioether intentionally crosslinked or branched in the course of production of the polymer (i.e., or after the polymerization) cannot be easily processed industrially into highly stretched fibers because such polymers have inadequate spinnability and stretchability and often cause breaking and fluffing in continuous melt-spinning and continuous stretching steps. On the other hand, a linear polyarylene-thioether produced without intentional crosslinking or branching treatment in the course of production of the polymer can be industrially processed into highly stretched fibers without breaking and fluffing in the continuous melt-spinning and continuous stretching steps, when suitable conditions are selected and a spinning oil is used.

The linear polyarylene-thioether to be used in the present invention has a melt viscosity in the range of 5,300 to 20,000 poise (at 310° C. and a shear velocity of 200 second$^{-1}$). Especially preferred are those having a melt viscosity of 6,000 to 20,000 poise, more preferably 7,000 to 15,000 poise. A linear polyarylene-thioether having a melt viscosity of less than 5,300 poise cannot easily be industrially subjected to continuous heat setting because melt breaking and fluffing often take place in the course of continuous heat setting of stretched fibers. Also, a polyarylene-thioether having a melt viscosity of more than 20,000 poise, which may have a linear structure, is not desirable because melt fracture takes place in the course of melt spinning to decrease spinnability and stretchability, and moreover breaking and fluffing often take place.

As described above, it is necessary that the polymer used to obtain the present high-quality stretched heatset filaments be a linear polyarylene-thioether having a melt viscosity of 5,300 to 20,000 poise. In this respect, "water-added two step polymerization process" and "process for production of superhigh molecular polyarylene-thioether" according to our previous inventions disclosed in Japanese Patent Application No. 126725/1984 (corresponding to U.S. Pat. No. 4,645,826) and No. 188533/1984 can be suitably applied to produce the polymers satisfying the above mentioned conditions.

The present invention is related to fibers produced from linear polyarylene-thioether resins thus obtained.

In general, such a linear polyarylene-thioether can be blended with other melt-miscible thermoplastic resins to form a blend. Thus, the "linear polyarylene-thioether" to be used in the present invention should be understood to encompass such a blend thereof with a small amount of other melt-miscible thermoplastic resins as long as such a blended resin does not impair the aim of the present invention. Also, a fiber-forming thermoplastic resin in certain instances contains auxiliary materials such as delustering agents, coloring agents and stabilizers. It should be thus understood that the "linear polyarylene-thioether" herein can contain such auxiliary materials.

Spinning and Stretching (1) Spinning

The term "spinning" herein means a step of shaping a polymer into filaments.

The spinning method in the present invention is a continuous melt spinning method. The "continuous melt spinning" means to continuously produce spun filaments by continuously extruding a molten polymer through an extruder equipped with a nozzle and reeling up the filaments with a reeling machine. The melt-spinning can be conducted by heat-melting the starting polymer to be used in the present invention at a temperature not lower than the melting point thereof, melt-extruding it through a nozzle having orifices of about 0.1 to about 2 mm in diameter, and taking up the resulting filament-like extrudate. The ratio of the take-up speed of the filament-like extrudate from the nozzle to the extrusion speed (i.e., so-called ratio $R_1$) is preferably in the range of from 10 to 1000. It is especially preferable that the $R_1$ be in the range of from 20 to 700 because then an intended high-quality product (i.e., stretched heat-set filaments) can be obtained without breaking and fluffing.

According to the method of the present invention, spun filaments can be produced over a long period of operation without substantial breaking and fluffing.

(2) Stretching

Stretching is conducted in succession to the step of spinning. "Stretching" means a process of drawing spun filaments by applying stress thereto in the length-wise direction. By orienting the polymer molecules to cause some crystallization in the course of stretching, the properties such as crystallinity, mechanical properties and thermal resistance of the final product can be enhanced.

The stretching method used in the present invention is a continuous stretching method. The "continuous stretching method" is not stretching of spun filaments in a batch-wise fashion, but means a method of continuously producing stretched filaments by continuously supplying spun filaments to a stretching region.

As a stretcher, a conventional stretching apparatus comprising a combination of godet rolls and a heating plate, heating pins, a heating roll, an infrared heater, a microwave heater, a hot air bath or a heating medium bath can be used. Especially, the heating plate, heating pins, heating roll and the like are suitable for the stretching of the present polyarylene-thioether filaments. The stretch ratio is preferably in the range of 2 to 15 times, and more preferably 2.5 to 10 times. When the ratio is less than 2 times, orientation of polymer chains in the filament is insufficient, and the resulting product lacks mechanical strength, thermal reistance, etc. A ratio of more than 15 times is not desirable because it gives rise to breaking and fluffing in many cases.

The stretching temperature is not higher than the melting point of the polymer used and is preferably a temperature between the "glass transition temperature" and the "glass transition temperature plus 60° C." of the polymer. A temperature lower than the glass transition temperature" is not desirable because molecular orientation of the polymer does not take place, and breaking and fluffing often occur. On the other hand, the stretching at a temperature higher than the "transition temperature plus 60° C." fails to enhance the properties of the final product because molecular motion of the polymer is too vigorous, and the spun filaments are drawn with random directions of the molecules. Spinning at a temperature higher than the melting point of the polymer is not desirable because of melt-breaking of spun filaments.

A spinning oil is preferably used in the continuous stretching step. As the spinning oil to be used in the stretching (and also heat-setting as detailed below) of spun filaments of the linear polyarylene-thioether according to the present invention, especially preferred is a combination of a so-called "smoothing agent" such as aromatic carboxylate ester, higher fatty acid esters, vegetable oils or mineral oils with a surface active agent. It is desirable to apply these agents in an emulsion state to spun filaments before the step of stretching.

Heat setting

The "heat setting" is a step of setting or promoting the molecular orientation and crystalline structure of the spun fibers obtained in the stretching step to obtain the fibers of excellent mechanical properties, thermal resistance and the like.

The heat-setting method to be used in the present invention is a continuous heat-setting method. The "continuous heat-setting method" is not such a batchwise heat setting as to heat-set the hank of filaments but is a method of producing heat-set filaments by continuously delivering stretched filaments to a heat-setting region for continuous heat setting.

As a heat-setting machine, a conventional heat-setting apparatus such as a heating plate, heating pins, a heating roll, an infrared or microwave heater, a hot air bath and a heating medium bath can be used. For example, a draw-twister comprising a stretching apparatus and a heat-setting apparatus in combination can also be employed.

In the heat-setting step, it is necessary to heat the stretched fibers to be heat-set to a temperature not lower than "the melting point thereof minus 100° C." A heating temperature not lower than the melting point is not desirable because of melt-breaking of the fiber. At a temperature lower than "the melting point minus 100° C." , an excessively long time is needed to conduct sufficient heat setting, which is economically undesirable for industrially producing continuously heat-set fibers.

The heat setting can be amply conducted in one step for ordinary purposes. When high thermal resistance, high elasticity and the like are needed, however, it is also possible to conduct multi-stage heat-setting steps with different temperatures. The period of heat setting is suitably selected depending on the thickness of the fibers, type of heating apparatus, the temperature of heat-setting, etc. In general, however, it is preferably in the range of 0.02 to 100 seconds. When the period is less than 0.02 second, it is difficult to raise the temperature of the fiber itself. When the heat-setting period is over 100 seconds, it is economically difficult to industrially conduct the continuous spinning, stretching and heat setting steps according to the present invention.

Properties of Fibers

The present polyarylene-thioether fibers produced under the above mentioned processing conditions from the starting linear polyarylene-thioether having a melt viscosity of 5,300 to 20,000 poise (at 310° C. and a shear velocity of 200 second$^{-1}$) are stretched heat-set fibers having markedly excellent properties, in comparison with the conventional polyarylene-thioether fibers (c.f. Kirk-Othmer: Encyclopedia of Chemical Technology, Third Edition, Vol. 18, page 793).

(1) Properties

The present fibers are in the form of multifilaments or monofilaments, that is, continuous fibers.

The fiber diameter thereof is in the range of 1 to 50 μm. According to the present method described above, fibers of fiber diameters in such a range can be readily obtained. In the case of multifilaments, thinner fibers are more easily produced. In the case of monofilaments, thicker fibers are more easily produced.

The present fibers have a tensile strength of not less than 20 kg/sq.mm. The present fibers are characterized by high tensile strength, generally of 40 kg/sq.mm or more. It is comparatively easy to obtain the fibers having tensile strengths of 60 kg/sq.mm or more depending on fiber diameter and stretching/heat-setting conditions.

The present fibers have a tensile modulus of elasticity of not less than 500 kg/sq.mm. It is also comparatively easy to obtain fibers having moduli of elasticity of 700 kg/sq.mm or more by suitably selecting fiber diameter and stretching/heat-setting conditions.

Another feature of the present fibers is good thermal resistance. More specifically, filaments having high-temperature strength, for example, thermal resistance shown by tensile strength at 200° C. of 20 kg/sq.mm or more can be readily obtained. The present fibers also have excellent chemical resistance, flame retardance, etc.

Whether the present fibers are in a dry state or a wet state has almost no influence on its properties. In contrast, the properties of aramide fibers (poly-p-phenyleneterephthalic amide fibers, poly-m-phenyleneterephthalic amide fibers) are halved in value in their wet state. (2) Uses The present stretched heat-set fibers produced from a high-molecular linear polyarylehe-thioether can be applied to a variety of uses by utilizing their characteristics, such as industrial filters, reinforcing fibers, heat-resistant clothing, heat insulators, tire cords, tapes for prepreg, wire coating materials and motor insulators.

EXPERIMENTAL EXAMPLES

Syntheses 1 through 4

For a pre-step polymerization, a 20-liter titanium-lined autoclave was charged with 11.0 kgs of N-methyl-2-pyrrolidone (hereinafter referred to as NMP) and 20.0 mols of $Na_2S.5H_2O$ salt crystals, and the mixture was gradually heated to about 200° C. with stirring under a nitrogen atmosphere to distill off 1.27 kgs of water, 1.57 kgs of NMP and 0.46 mol of $H_2S$. After allowing the system to cool to 130° C., 19.73 mols of p-dichlorobenzene (hereinafter referred to as P-DCB) and 3.2 kgs of NMP were added thereto, and polymerization was carried out at 210° C. for 9 hours (thus ending the pre-step polymerization).

Then, water was added to the polymerization system so that the water present therein reached the ratio shown in Table 1. The mixture was heated under a nitrogen atmosphere and further subjected to polymerization (post-step polymerization) under the polymerization conditions shown in Table 1. After cooling, the resulting polymerization mixture was filtered, repeatedly washed with deionized water and then dried at 100° C. for 3 hours, to obtain polyphenylene-thioether polymers [(P-1) through (P-4)].

Synthesis 5

The procedure of Synthesis 1 was followed except for the use of a mixture of 19.00 mols of P-DCB and 0.73 mol of meta-dichlorobenzene (herein referred to as M-DCB) in place of 19.73 mols of P-DCB.

Polyphenylene-thioether (P-5) was obtained.

Synthesis 6

A titanium-lined 20-liter autoclave was charged with 11.0 kgs of NMP and 16.0 mols of $Na_2S.5H_2O$ salt crystals, and the mixture was heated with stirring under a nitrogen atmosphere to distill off water. The S content distilled away as $H_2S$ was 1.5 molar %. After cooling, 16.1 mols of P-DCB and 3.0 kgs of NMP were added thereto and the resulting mixture was subjected to polymerization at 210° C. for 10 hours. Then, 53 mols of water was added thereto, and the mixture was reacted at 250° C. for 0.25 hour. The resulting reaction mixture liquor (P) thus prepared was taken out of the autoclave and stored.

A small amount of the liquor (P) was sampled to measure the polymerization degree of the resulting p-phenylene-thioether prepolymer (by fluorescent X-ray method). The degree of polymerization was 300.

Separately, a 20-liter autoclave was charged with 11.0 kgs of NMP and 16.0 mols of $Na_2S.5H_2O$, and the mixture was heated to about 200° C. to distill off water (loss of the S content = 1.5 molar %). Then, 15.5 mols of M-DCB, 3.0 kgs of NMP and 53 mols of water were added thereto. The resulting mixture was cooled with stirring to prepare an unreacted mixture liquor (M), which was then taken out of the autoclave and stored.

Then, a 20-liter autoclave was charged with 13.6 kgs of the liquor (P) and 3.4 kgs of the liquor (M), and the mixture was reacted at 262° C. for 5 hours. After termination of the reaction, the resulting reaction mixture was separated by filtration, washed with hot water and dried under reduced pressure to recover a phenylene-thioether block copolymer (P-6).

By way of infrared analysis, the ratio of repeating units present in the polymer block was determined. As a result, the

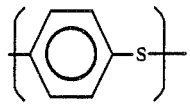

unit was 83 molar %, and the

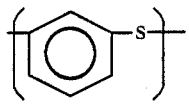

unit was 17 molar %.

Synthesis 7 (Comparative Example)

For comparison, the pre-step polymerization process of the syntheses 1 through 4 was repeated except that a mixture of 19.68 mols of P-DCB and 0.05 mol of 1,2,4-trichlorobenzene was used instead of 19.73 mols of P-DCB. Only the pre-step polymerization at 250° C. for 4 hours (without a post-step polymerization) was conducted to obtain a crosslinked polyphenylene-thioether (P-7).

Synthesis 8 (Comparative Example)

Also for comparison, the pre-step polymerization process of the syntheses 1 through 4 was repeated except that the pre-step polymerization was conducted at 250° C. for 4 hours to obtain a polymer (melt viscosity 320 poise). The resulting polymer was heated in air at 250° C. for 8 hours to obtain a heat-treated crosslinked polyphenylene-thioether (P-8).

The synthetic conditions and properties of the eight polyphenylene-thioether polymers are shown in the following Table 1.

As to the polymer (P-1), the same synthetic reactions were conducted in 5 batches, and the resulting polymers of three batches were blended. The resulting polymer blend was used as the polymer (P-1) sample in the spinning experiment given below.

The glass transition temperature $T_G$ and melting point Tm of the polymers were measured according to a DSC method. The melt viscosity thereof was measured under the conditions of a temperature of 310° C. and a shear velocity of 200 second$^{-1}$.

Each powder of these eight polyphenylene-thioether polymers was melt-extruded at 320° C. into pellets and subjected to spinning experiments.

TABLE 1

| | Post-step Polymerization | | | Polymer | | | |
|---|---|---|---|---|---|---|---|
| Polymer No. | $H_2O/Na_2S$ (mol/mol) | Temp. (°C.) | Time (hrs) | Melt viscosity (poise) | $T_G$ (°C.) | Tm (°C.) | Structure |
| P-1 | 4.4 | 260 | 5 | 7300 | 85 | 278 | linear, homopolymer |
| P-2 | 4.0 | 265 | 6 | 15500 | 83 | 276 | " |
| P-3 | 5.0 | 258 | 5 | 3200 | 90 | 282 | " |
| P-4 | 3.8 | 265 | 6 | 21000 | 80 | 275 | " |

TABLE 1-continued

| Polymer No. | Post-step Polymerization $H_2O/Na_2S$ (mol/mol) | Temp. (°C.) | Time (hrs) | Polymer Melt viscosity (poise) | $T_G$ (°C.) | Tm (°C.) | Structure |
|---|---|---|---|---|---|---|---|
| P-5 | 4.4 | 260 | 5 | 4800 | 78 | 275 | linear, copolymer |
| P-6 | — | — | — | 6900 | 77 | 277 | linear, block copolymer |
| P-7 | — | — | — | 7200 | 89 | 280 | non-linear homopolymer |
| P-8 | — | — | — | 7500 | 86 | 280 | non-linear, homopolymer |

EXAMPLES (1) Spinning

Continuous melt-spinning was conducted for 6 hours to produce spun filaments by means of a melt-spinning tester (supplied by Fuji Filter K.K., Japan), and the states of breaking and fluffing of the filaments were observed. The spinning conditions were as follows.

nozzle: 18 orifices each of 0.5 mm in diameter,
nozzle temperature: 315° C.,
extrusion rate: 5.2 g/minute
take-up speed: 90 to 110 m/minute
cooling: air blast cooling.

(2) Stretching

Only the spun filaments taken up without frequent breaking and fluffing in the spinning operation were subjected to continuous stretching operations for 6 hours by means of a hot plate (supplied by Toyo Denki K.K., Japan). The resulting spun filaments were observed with respect to the states of breaking and fluffing.

In the stretching operation, an oil agent consisting by weight of 40 parts of trioleyl trimellitate, 20 parts of isostearyl oleate, 25 parts of ethyleneoxide/propyleneoxide block copolymer, 10 parts of dodecylphenol ethyleneoxide adduct and 5 parts of oleic acid-diethanolamine salt was used in 7% emulsion as a spinning agent. The oil agent was applied to spun filaments with a feed roller in an amount of 0.1 to 2.0% by weight. The continuous stretching conditions were as follows.

stretching speed: 70 to 100 m/minute
stretching temperature (at the hot plate surface): 95° C.
stretching rate: 4 times.

The results of breaking and fluffing are shown in Table 2.

(3) Heat setting

Only the spun filaments taken up without frequent breaking and fluffing were subjected to continuous heat-setting operations for 6 hours by means of a heating plate (supplied by Toyo Denki K.K., Japan). The resulting heat-set filaments were observed with respect to the states of melt-breaking, breaking and fluffing. The continuous heat-setting conditions were as follows.

heat-setting temperature (at the hot plate surface): see Table 2
heat-setting time: period of time contacting the hot plate): see Table 2
heat-setting rate: 1.05 times.

The results of breaking and fluffing are shown in the following Table 2.

The properties of the stretched heat-set fibers are shown in the following Table 3.

TABLE 2

| Spinning No. | Starting polymer | Melt-spinning step R1 | Breaking & fluffing | Stretching step Hot plate temp. (°C.) | Stretch ratio (times) | Breaking & fluffing | Heat-setting step Hot plate temp. (°C.) | Heat-setting time (second) | Breaking & fluffing |
|---|---|---|---|---|---|---|---|---|---|
| Ex. 1 | P-1 | 90-110 | no | 95 | 4 | no | 240 | 0.3 | no |
| Ex. 2 | P-2 | 90-110 | " | " | 4 | " | 245 | 0.3 | no |
| Comp. Ex. 1 | P-3 | 90-110 | " | " | 4 | " | 180 | 0.3 | much (with melt-breaking) |
| Comp. Ex. 2 | P-4 | 90-110 | " | " | 4 | much | 250 | 0.3 | much |
| Comp. Ex. 3 | P-5 | 90-110 | " | " | 4 | no | 220 | 0.3 | much |
| Ex. 3 | P-6 | 90-110 | " | " | 4 | " | 230 | 0.3 | no |
| Comp. Ex. 4 | P-7 | 90-110 | some | " | 4 | much | — | — | — |
| Comp. Ex. 5 | P-8 | 90-110 | some | " | 4 | " | — | — | — |
| Ex. 4 | P-1 | 90-110 | no | " | 4 | no | 220 | 0.1 | no |
| Comp. Ex. 6 | P-1 | 90-110 | " | " | 4 | " | 160 | 0.1 | no |
| Ex. 5 | P-1 | 90-110 | " | " | 4 | " | 260 | 0.1 | no |
| Comp. Ex. 7 | P-1 | 90-110 | " | " | 4 | " | 290 | 0.1 | much (with melt-breaking) |
| Ex. 6 | P-6 | 90-110 | " | " | 4 | " | 210 | 0.1 | no |
| Ex. 7 | P-6 | 90-110 | " | " | 4 | " | 250 | 0.1 | no |

*Tensile strength at 200° C.

TABLE 3

| Spinning No. | Fiber diameter (μ) | Tensile strength ($kg/mm^2$) | Tensile modulus of elasticity ($kg/mm^2$) | High-temperature strength* ($kg/mm^2$) | Remarks |
|---|---|---|---|---|---|
| Ex. 1 | 20 | 65 | 680 | >25 | — |
| Ex. 2 | 22 | 65 | 680 | >25 | — |
| Comp. Ex. 1 | — | — | — | — | not heat settable |
| Comp. Ex. 2 | 24 | 65 | 650 | >25 | much fluffing |
| Comp. Ex. 3 | 21 | 63 | 600 | >25 | much fluffing |
| Ex. 3 | 18 | 70 | 750 | >25 | — |
| Comp. Ex. 4 | — | — | — | — | not heat settable |
| Comp. Ex. 5 | — | — | — | — | not heat settable |
| Ex. 4 | 22 | 69 | 630 | >25 | — |

TABLE 3-continued

| Spinning No. | Fiber diameter (μ) | Tensile strength (kg/mm²) | Tensile modulus of elasticity (kg/mm²) | High-temperature strength* (kg/mm²) | Remarks |
|---|---|---|---|---|---|
| Comp. Ex. 6 | 20 | 46 | 600 | 5 | low heat-setting temperature |
| Ex. 5 | 23 | 63 | 680 | >25 | — |
| Comp. Ex. 7 | — | — | — | — | not heat settable |
| Ex. 6 | 18 | 69 | 740 | >25 | — |
| Ex. 7 | 18 | 62 | 700 | >25 | — |

What is claimed is:

1. Stretched, heat-set polyarylene-thioether fibers having substantially no fluffing and which simultaneously satisfy the following conditions:

(a) the polyarylene-thioether is a linear polyarylene-thioether having a melt viscosity of 6,000 to 20,000 poise determined at a temperature of 310° C. and a shear velocity of 200 second$^{-1}$;

(b) the fiber diameter is in the range of 1 to 50 microns;

(c) the tensile modulus of elasticity is not less than 500 kg/sq. mm; and (d) the tensile strength at 200° C. is not less than 20 kg/sq. mm.

2. The fibers according to claim 1, in which the polyarylene-thioether contains as a main component a repeating unit of

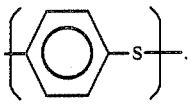

3. The fibers according to claim 1, in which the polyarylene-thioether is a block copolymer consisting essentially of not less than 50 molar % of a repeating unit

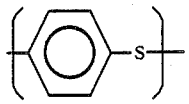

and 5 to 30 molar % of a repeating unit

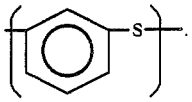

* * * * *